United States Patent [19]

Braun

[11] 4,036,087

[45] July 19, 1977

[54] APPARATUS FOR CUTTING STRIP MATERIAL INTO LENGTHS AND FOR STACKING THE CUT LENGTHS OF STRIP MATERIAL

[75] Inventor: Hans Braun, Weilheim, Germany

[73] Assignee: L. Schuler GmbH, Germany

[21] Appl. No.: 635,111

[22] Filed: Nov. 25, 1975

[30] Foreign Application Priority Data

Nov. 27, 1974 Germany ..... 2455937

[51] Int. Cl.[2] ..... B65H 35/06

[52] U.S. Cl. ..... 83/79; 83/94; 83/98; 83/110; 83/152; 83/154; 271/211

[58] Field of Search ..... 83/79, 94, 98, 110, 83/152, 156, 151, 154; 271/211, 224

[56] References Cited

U.S. PATENT DOCUMENTS

| | | | |
|---|---|---|---|
| 2,769,495 | 11/1956 | Pomper et al. | 83/98 X |
| 3,022,999 | 2/1962 | Mead | 271/224 |
| 3,032,340 | 5/1962 | Lawrence | 271/224 X |
| 3,279,792 | 10/1966 | Kostal et al. | 271/211 X |
| 3,334,895 | 8/1967 | Daniels et al. | 271/211 |
| 3,477,323 | 11/1969 | Osborn | 83/94 X |
| 3,491,902 | 1/1970 | Waldura | 271/211 X |
| 3,498,599 | 3/1970 | Smith | 271/211 |

FOREIGN PATENT DOCUMENTS

| | | | |
|---|---|---|---|
| 901,906 | 7/1962 | United Kingdom | 271/211 |

*Primary Examiner*—Frank T. Yost
*Attorney, Agent, or Firm*—Craig & Antonelli

[57] ABSTRACT

Apparatus for processing flat strip material including cutting apparatus for cutting the material and to strip portions and stacking apparatus having air cushion means for stacking the strip portions one on top of the other. An accelerating anchoring roller, having vacuum or magnet devices therein for attracting the sheet portions thereto are provided for the exclusive transfer of the strip portions from the position were cut in the cutting apparatus in positions at the inlet of the stacking apparatus where the air cushion takes over the conveyance and stacking of the strip portions.

16 Claims, 2 Drawing Figures

APPARATUS FOR CUTTING STRIP MATERIAL INTO LENGTHS AND FOR STACKING THE CUT LENGTHS OF STRIP MATERIAL

BACKGROUND AND SUMMARY OF THE INVENTION

The invention relates to apparatus for cutting strip material into lengths and for stacking the cut lengths of strip material. More specifically, the present invention relates to an arrangement having a cutting apparatus and, downstream of the cutting apparatus, a stacking apparatus in which a stream of air acting in the direction of conveyance is fed to the underside of the portions of strip material and serve to form a cushion of air. The stacking apparatus is provided with a stacking space adjustable to the size of the portions of strip material, the length of the stacking space being defined by an adjustable stop, the contacting of which by the portions of strip material commences the stacking process.

Where the automatic cutting of strip material which is fed continuously from a reel to a cutting apparatus is concerned, it is generally conventional for the cut portions of strip material to be conducted onto a conveying apparatus such as a conveyor belt, on which the portions of strip material are fed to a subsequent stacking arrangement and are stacked. Such an apparatus is described in U.S. Pat. No. 2,882,048. A guillotine blade cuts from the strip material, portions which are fed by means of the interposed conveyor belt to two oppositely driven conveyor rollers of a stacking arrangement. The two conveyor rollers convey the strip material portions into a stacking space. Provided at the level of the bottom conveyor roller is an air nozzle which guides a stream of air in the conveying direction beneath the portion of strip material which is to be stacked. The air stream generates in the predominantly closed stacking space a cushion of air which diminishes the rate of lowering of the portions of strip material which are to be stacked. At the end of the stacking space, the size of which can be adjusted according to the size of the portions of strip material, there is, constructed as a switching element, an abutment which upon being actuated by the portion of strip material, initiates the stacking process in which additional air jets provided on the feed side of the stacking arrangement and acting at right-angles to the direction of conveyance, become activated. The additional air jets, upon commencement of the stacking operation, impart to the portion of strip material which is to be stacked a greater lowering speed in comparison with the other end, so reliably avoiding the subsequent portion of strip material becoming pushed under the preceding portion.

In the case of the apparatus described, there is between the cutting arrangement for the strip material which is to be cut into lengths and the stacking arrangement for the cut lengths of strip material a separate conveyor belt which means that the space required by the apparatus is relatively great.

Therefore, the object of the invention is, while avoiding having a separate conveyor belt, to couple a stacking arrangement directly to a cutting arrangement.

According to preferred embodiments of the invention, the abovenoted problems are resolved by providing that the portions of strip material are fed from the cutting apparatus directly to the under side of at least one accelerating anchoring roller which is mounted in a frame of the stacking apparatus, on the feed side thereof, above the air stream acting in the direction of conveyance and at the commencement of the stacking space.

The invention is distinguished by compact construction which is achieved by the direct coupling of the stacking arrangement onto the cutting arrangement without the interposition of a separate conveyor belt.

Furthermore, the apparatus of the present invention eliminates an additional source of faults, constituted in the above-discussed prior arrangements by breakdowns of the conveyor belt caused for example by increased wear and/or damage.

The type of cutting arrangement used in practicing the present invention can be chosen according to particular requirements, and it is contemplated for example to use an oscillating drum cutter such as disclosed in (DL Pat. No. 97,362 or U.S. Pat. No. 3,791,244), a roller cutter or a guillotine blade. Commonly assigned U.S. Pat. No. 3,881,382 discloses a flying shear arrangement that could be used with the present invention.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
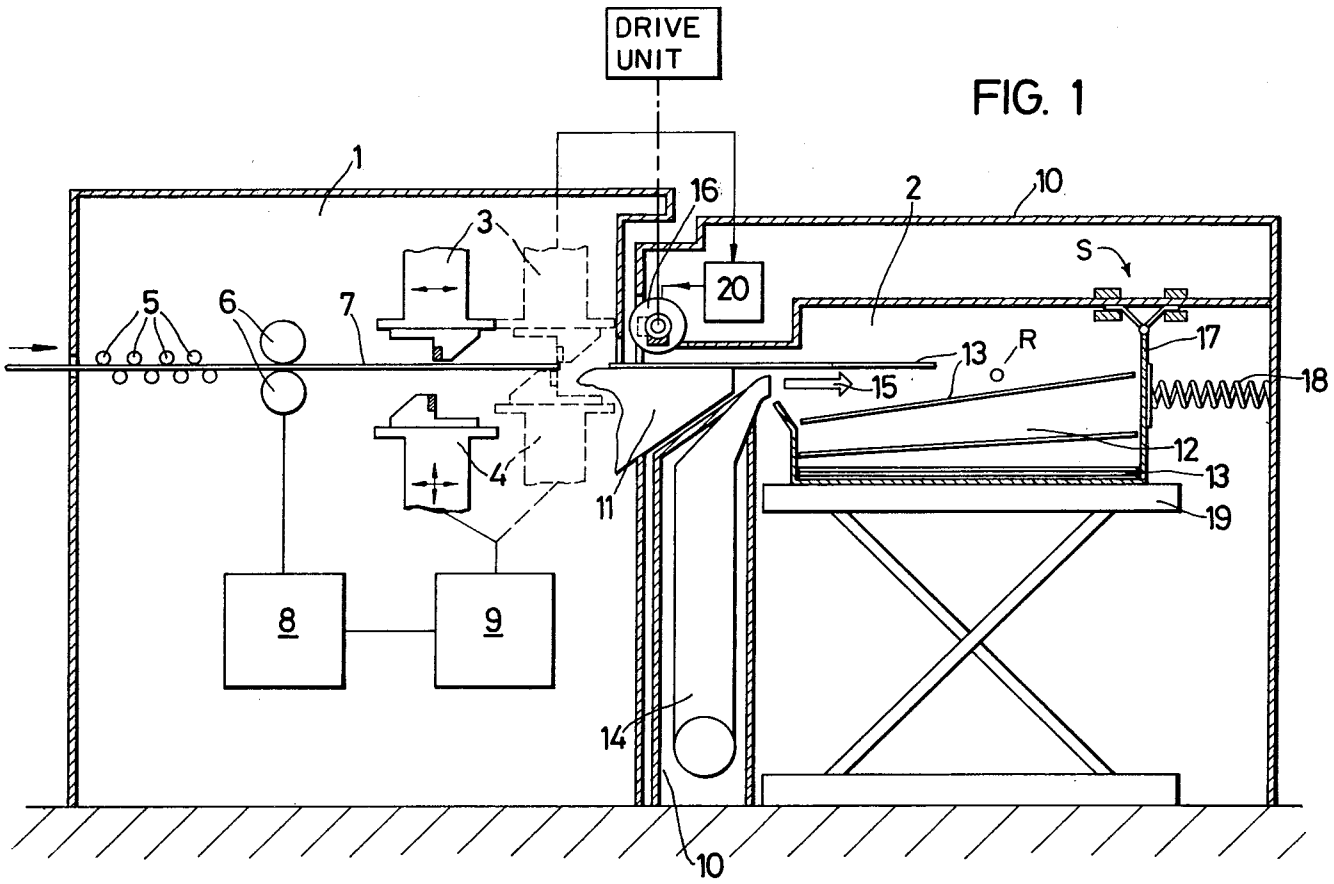
FIG. 1 is a side part-sectional view of a first embodiment of apparatus constructed in accordance with the invention.

In both illustrated embodiments, the illustrations of the apparatus are highly diagrammatic showing essentially a cutting apparatus 1 and, directly downstream thereof, a stacking arrangement 2. The cutting arrangement 1 is illustrated as being a guillotine comprising a horizontally movable top knife 3 and a horizontally and vertically movable bottom knife 4. Strip material 7 from a reel, not shown in greater detail, is fed to the cutting apparatus 1 via a directing apparatus 5 and drive rollers 6. The movement of the drive rollers 6 and the movement of the top and bottom knives 3, 4 are derived from a common drive 8 which acts via a gear mechanism 9 on the top and bottom knives 3, 4 of the cutting apparatus 1.

Further details of the cutting apparatus are not included herein in order not to obscure the invention. One skilled in the art, when viewing the present description and the prior art as exemplified by above-noted U.S. Pat. No. 3,881,382, will readily be able to practice the invention.

The stacking arrangement 2 immediately follows the cutting apparatus 1 and has a frame 10 which engages over a delivery table 11 of the cutting apparatus 1, and has a stacking space 12 in which cut portions of strip material 13 are stacked. The stack space 12 is preferably adjustable in size so that variously sized portions 13 of strip material can be stacked. Provided at the feed side of the stacking arrangement 2 is an air jet 14 which is supplied with air via a fan, not shown in greater detail. The air is fed in the direction of conveyance to the portions 13 of strip material which are to be stacked, from the underside, and serves as a cushion of air for stacking purposes. At the start of the stacking space 12, above the air stream 15 acting in the direction of conveyance, an anchoring roller 16 which has an accelerating effect on the portions 13 of strip material is mounted in the frame 10 of the stacking arrangement 2. The anchoring roller 16 is rotatably driven by drive means, not shown in greater detail, which are associated with the stacking arrangement 2. Details that are not included herein of anchoring roller and drive means constructions can be found in U.S. Pat. No. 1,444,999 to Bennett et al; U.S. Pat. No. 3,008,709 to Buslik; and German Pat. No. 1,481,162, published Apr. 15, 1971.

The length of the stacking space 12 is defined by an adjustable stop 17 which can be pivoted against the pressure of a spring 18 supported on the frame 10. The underside of the stacking space 12 is constituted by a stacking table 19, the position of which is adjustable according to the stacked quantity of strip material portions 13. In the illustrated embodiments, the anchoring roller 16 is constructed as a magnetic roller and is built up by means of a permanent magnet which is pivotably mounted within the anchoring roller 16. In the case of strip material portions 13 of magnetisable material, the anchoring effect can be generated by the magnetic field. The above-noted German Pat. No. 1,481,162 shows details of a roller with a permanent magnet. The above-noted U.S. Pat. No. 1,444,999 shows details of an electromagnet roller that could also be used in the present invention.

Instead of the magnetic roller, it is contemplated also to use a vacuum roller as the anchoring roller 16 if for example strip material of anti-magnetic material, for example brass, aluminum, is being handled. The above-noted U.S. Pat. No. 3,008,709 includes details of a vacuum roller.

In the case of the apparatus according to FIG. 1, the anchoring roller 16 is so mounted on the frame 10 on the feed side of the stacking apparatus 2 that the gap between the anchoring roller 16 and the top and bottom knives 3, 4 of the cutting apparatus 1 is as small as possible at the cutting point. In order to control the anchoring effect of the anchoring roller 16, a control device 20 is provided to which appropriate controlling pulses are fed by the cutting apparatus 1.

The apparatus functions in the following way:

The strip material 7 is pulled off the reel, not shown in greater detail, by the directing apparatus 5 and the drive rollers 6 and is cut to the pre-selected length by the top and bottom knives 3, 4 of the cutting apparatus 1. The resultant portions 13 of strip material arrive on the delivery table 11 and are conveyed into the stacking space 12 by the anchoring roller 16, undergoing acceleration thereby with respect to the rate of feed of the strip material 7. The acceleration results from the fact that immediately following the cutting process, a control pulse is fed to the control device 20 by the cutting apparatus 1 so that the anchoring effect of the anchoring roller 16 is briefly activated. The rotating anchoring roller 16 imparts an accelerating pulse to the portion 13 of strip material which has been cut to length.

By means of the air stream 15 emerging from the air jet 14 and acting in the direction of conveyance against the underside of the strip material portions 13, these latter are conveyed to the abutment 17 and are stacked on the stacking table 19 in the stacking space 12. The rate of lowering of the portions of strip material 13 is thereby determined by the air cushion formed by the air stream 15. Furthermore, one it has passed below the exit orifice of the air jet 14, the air stream 15 has the effect of projecing increased downward thrust on the portions 13 of strip material which are to be stacked, on the feed side of the stacking apparatus 2 compared with the side formed by the abutment 17. This ensures that the subsequent portion 13 of strip material cannot be pushed under the preceding one. The stop 17 which can be pivoted against the thrust of the spring 18 guarantees an accurate stacking of the strip material portions 13 on the stacking table 19 in that the pressure of the spring 18 acting on the abutment 17 brings the portions 13 of strip material into a definite position during the stacking process.

Figure 2:
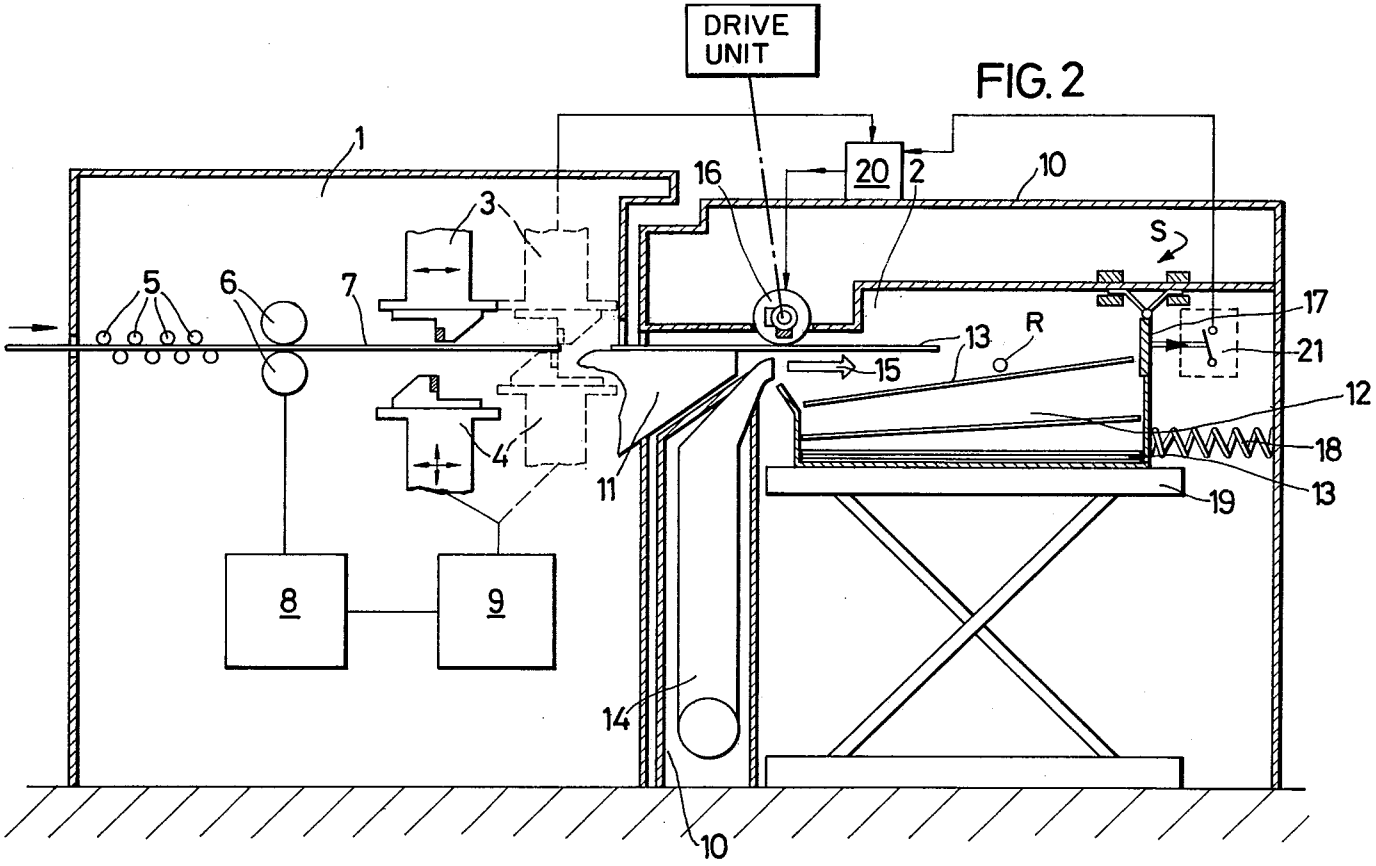
FIG. 2 is a side part-sectional view of a further embodiment of the invention.

The apparatus according to FIG. 2 is provided with a stacking apparatus 2, of which the anchoring roller 16 is mounted in the frame 10 directly at the commencement of the stacking space 12. Furthermore, the adjustable abutment 17 is connected to a switching element 21 which can be actuated by a portion 13 of strip material abutting against the adjustable stop 17. The switching element 21 is connected to the control device 20.

The cut-to-length strip material portions 13 pass via the delivery table 11 of the cutting apparatus 1 to the underside of the anchoring roller 16 which conveys the portions 13 of strip material into the stacking space 12 under acceleration with respect to the speed of conveyance of the driving rollers 6. By virtue of the air stream 15 emerging from the air jet 14 against the underside of the strip material portions 13 and acting in the direction of conveyance, the strip material portions 13 are conveyed to the stop 17. The abutting portion of strip material emits by means of the switching element 21 a pulse which is so processed by the control device 20 that the anchoring effect of the anchoring roller 16 is briefly interrupted. In the case of a magnetic roller, this is achieved for example by a pivoting down of a permanent magnet mounted in the magnetic roller or, in the case of a vacuum roller, preferably by a reversal of pressure. As a result, a sufficient downward thrust is imparted to the portion 13 of strip material that it is possible reliably to avoid the subsequent portion 13 of strip material being pushed under the previous portion. The lowering rate of the portions 13 of strip material which are to be stacked is here also defined by the air cushion formed by the air stream 15.

The rest of the stacking process will become evident from the preceding description with regard to FIG. 1.

When long length portions 13 of strip material are being cut, the gap between the cutting point in the cutting apparatus 1 and the anchoring roller 16 in the stacking arrangement 2 will become shorter than the length of the portions of strip material 13 and the anchoring effect of the anchoring roller 16 must not become effective until immediately following the cutting process. in order to control this process, it is possible to pick up from some suitable place in the cutting apparatus 1 a control pulse which can be fed to the control device 20. Immediately following the cut, this pulse activates the anchoring roller 16 which is de-activated by a portion 13 of strip material when the switching element 21 is actuated.

The control device 20 is contemplated to be of simple design. Since during operation of the apparatus the drive means rotates continuously the roller 16, the only function of the control device 20 is to activate and to de-activate the vacuum or the magnets.

In the embodiment of FIG. 1 the control device 20 is a switch with a timer. The signal derived from the position of the flying shear moves the switch into the position corresponding to the activation of the vacuum or the magnets. After elapse of the time preset at the timer the switch is moved into the position corresponding to the deactivation of the vacuum or the magnets.

In the embodiment of FIG. 2 the control device 20 is a switch. The signal derived from the position of the flying shear moves the switch into the position corresponding to the activation of the vacuum or magnets and the signal derived from switching element 21 moves the switch into the position belonging to the de-activation of the vacuum or magnets.

In the embodiments with a permanent magnet at the anchoring roller 16, the control device operates to move the permanent magnet between respective inactive and active positions (see respective dash and solid line showing of permanent magnet inside roller 16 in the drawings). In electromagnetic embodiments and in vacuum embodiments, the control device merely controls the electric current supply and the vacuum supply to the roller 16.

By using a means, not shown, of forming an intermediate stack, as can be seen for example in German Pat. No. 1,756,852 or U.S. Pat. 2,733,921, it is possible to exchange a fully stacked stacking table 19 for an empty stacking table 19 without interrupting the cutting and stacking process of an apparatus according to the invention. Where such means are concerned, the holders provided lengthwise of the conveying direction, which are brought into the stacking space 12 in order to form an intermediate stack during the change over of stacking tables, will be of a length corresponding to the length of the stacking space 12.

While I have shown and described several embodiments in accordance with the present invention, it is understood that the sme is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Apparatus for processing strip material comprising:

cutting apparatus for cutting strip material into strip portions, stacking apparatus disposed downstream of said cutting apparatus and including means for stacking said strip portions adjacent one another, said stacking apparatus including air supply means for supplying air to respective undersides of said portions to form a cushion of air for said strip portions as they are stacked, and an accelerating anchoring roller member engageable with said strip portions for acceleratingly conveying strip portions from the cutting apparatus to respective positions adjacent an inlet portion of said stacking apparatus where they are engaged by said air from said air supply means, said anchoring roller means forms the exclusive means for transferring said strip portions from respective positions where they are cut to respective positions at said inlet portion of said stacking apparatus where they are engaged by and controlled by said air from said air supply means, said anchoring roller member includings anchoring means for aiding in anchoring said strip portions for movement with peripheral portions of said anchoring roller member, said anchoring roller member is disposed in a frame of the stacking apparatus above an air outlet of said air supply means, and control means for controlling an anchoring effect of the anchoring means as a function of the cutting process in the cutting process.

2. Apparatus for processing strip material comprising:

cutting apparatus for cutting strip material into strip portions, stacking apparatus disposed downstream of said cutting apparatus and including means for stacking said strip portions adjacent one another, said stacking apparatus including air supply means for supplying air to respective undersides of said portions to form a cushion of air for said strip portions as they are stacked, an accelerating anchoring roller member engageable with said strip portions for acceleratingly conveying said strip portions from the cutting apparatus to respective positions adjacent an inlet portion of said stacking apparatus where they are engaged by said air from said air supply means, said anchoring roller member forms the exclusive means for transferring said strip portions for respective positions where they are cut to respective positions at said inlet portion of said stacking apparatus where they are engaged by and controlled by said air from said air supply means, said anchoring roller member includes anchoring means for aiding in anchoring said strip portions for movement with peripheral portions of said anchoring roller member, said anchoring roller member is disposed in a frame of the stacking apparatus above an air outlet of said air supply means, said anchoring means includes means for applying a vacuum pressure to said anchoring roller member, and a switching element for briefly reversing the pressure at said anchoring roller member.

3. Apparatus according to claim 2, wherein drive means are provided for rotatably driving said anchoring roller member.

4. Apparatus according to claim 2, wherein said anchoring roller member is disposed immediately adjacent the position where said cutting apparatus completes cutting of said strip portions.

5. Apparatus according to claim 2, wherein said anchoring roller member is disposed immediately adjacent the air outlet of said air supply means at a position spaced from the cutting position where said cutting apparatus completes cutting of said strip portions.

6. Apparatus according to claim 2, wherein said switching element is controlled by control means responsive to engagement of a strip portion with a predetermined control portion of said stacking apparatus.

7. Apparatus according to claim 9, wherein said stacking apparatus includes an adjustable stop member defining the length of the stacking space of the stacking apparatus.

8. Apparatus according to claim 7, wherein said adjustable stop is mounted for pivotal movement against the force of a spring.

9. Apparatus according to claim 2, wherein said stacking apparatus includes means for forming an intermediate stack, whereby the primary stack of strip portions can be moved from the stacking apparatus without interrupting the cutting and stacking apparatus.

10. Apparatus for processing strip material comprising:

cutting apparatus for cutting strip material into strip portions, stacking apparatus disposed downstream of said cutting apparatus and including means for stacking said strip portions adjacent one another, said stacking apparatus including air supply means for supplying air to respective undersides of said portions to form a cushion of air for said strip portions as they are stacked, an accelerating anchoring roller member engageable with said strip portions for acceleratingly conveying said strip portions from the cutting apparatus to respective position adjacent an inlet portion of said stacking apparatus where they are engaged by said air from said air supply means, said anchoring roller member forms the exclusive means for transferring said strip portions from respective positions where they are cut to respective positions at said inlet portion of said stacking apparatus where they are engaged by and controlled by said air from said air supply means, said anchoring roller member includes anchoring means for aiding in anchoring said strip portions for movement with peripheral portions of said anchoring roller member, said anchoring roller member is disposed in a frame of the stacking apparatus above an air outlet of said air supply means, the anchoring means includes means for applying a magnetic field at said anchoring roller member to magnetically attract said strip portion to said anchoring roller member.

11. Apparatus according to claim 10, wherein said anchoring roller member is disposed immediately adjacent the position where said cutting apparatus completes cutting of said strip portions.

12. Apparatus according to claim 10, wherein switch means are provided for briefly eliminating said magnetic field attractor.

13. Apparatus according to claim 10, wherein said stacking apparatus includes an adjustable stop member defining the length of the stacking space of the stacking apparatus.

14. Apparatus according to claim 13, wherein said adjustable stop is mounted for pivotal movement against the force of a spring.

15. Apparatus according to claim 10, wherein said stacking apparatus includes means for forming an intermediate stack, whereby the primary stack of strip portions can be moved from the stacking apparatus without interrupting the cutting and stacking apparatus.

16. Apparatus according to claim 10, wherein said anchoring roller member is disposed immediately adjacent the air outlet of said air supply means at a position spaced from the cutting position where said cutting apparatus completes cuttng said strip portions.

* * * * *